US006968721B2

(12) United States Patent
Tabuchi et al.

(10) Patent No.: US 6,968,721 B2
(45) Date of Patent: Nov. 29, 2005

(54) METHOD OF MANUFACTURING BLADE RETAINER AND MANUFACTURING DEVICES THEREFOR

(75) Inventors: Kenjiro Tabuchi, Fujisawa (JP); Go Nabatame, Fujisawa (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 10/400,805

(22) Filed: Mar. 28, 2003

(65) Prior Publication Data

US 2004/0040360 A1 Mar. 4, 2004

(30) Foreign Application Priority Data

Mar. 29, 2002 (JP) ..... 2002-095683

(51) Int. Cl.[7] ..... B21D 5/04; B21D 28/18

(52) U.S. Cl. ..... 72/294; 72/311; 72/312; 72/337; 72/461; 83/268

(58) Field of Search ..... 72/311–313, 461, 72/316, 294, 331, 330, 340, 337; 83/653, 83/955, 268, 247, 686, 128, 207, 228

(56) References Cited

U.S. PATENT DOCUMENTS

| | | | | | |
|---|---|---|---|---|---|
| 1,573,810 | A | * | 2/1926 | Cunningham | 72/331 |
| 1,721,810 | A | * | 7/1929 | Carter | 72/362 |
| 2,460,281 | A | * | 2/1949 | Garberding | 72/294 |
| 3,310,973 | A | * | 3/1967 | Leis | 72/420 |
| 3,931,671 | A | * | 1/1976 | Dittmann | 29/753 |
| 3,986,379 | A | * | 10/1976 | Mansell | 72/57 |
| 4,011,781 | A | * | 3/1977 | Whistler, Jr. | 83/387 |
| 4,395,901 | A | * | 8/1983 | Lewis | 72/461 |
| 4,450,611 | A | | 5/1984 | Ito et al. | 29/156.8 |
| 4,624,124 | A | * | 11/1986 | Reyes et al. | 72/403 |
| 5,261,790 | A | | 11/1993 | Dietz et al. | 416/193 |
| 5,458,717 | A | * | 10/1995 | Kurita | 156/263 |
| 5,868,025 | A | | 2/1999 | Fukuda et al. | 72/335 |
| 5,869,194 | A | | 2/1999 | Dwyer | 428/542.8 |
| 5,946,962 | A | | 9/1999 | Fukuda et al. | 72/335 |
| 6,163,734 | A | | 12/2000 | Shigefuji et al. | 700/160 |
| 6,354,803 | B1 | | 3/2002 | Grover et al. | 416/190 |
| 6,382,916 | B1 | | 5/2002 | Gomi et al. | 416/197 |
| 6,457,942 | B1 | | 10/2002 | Forrester | 416/220 |

* cited by examiner

*Primary Examiner*—Daniel C. Crane
(74) *Attorney, Agent, or Firm*—Adduci, Mastriani & Schaumberg, L.L.P.

(57) ABSTRACT

A method of manufacturing a turbine blade retainer using a material cutting device and a material bending device includes steps for suspending a bar stock material between a polyurethane shock absorber and a bore of a cutting jig support, moving the cutting punch downward to press the distal end of the bar stock material into the shock absorber and then cut the bar stock material to thereby generate a blank, clamping the blank between a bending punch and a receiving slide by pressing the bending punch against the receiving slide, bending the distal end of the blank against a chamfered section of a bending support in response to continued downward motion of the bending punch to thereby form a blade retainer precursor, and milling the blade retainer precursor to form the blade retainer. Corresponding devices for performing these steps are also described.

22 Claims, 8 Drawing Sheets

METHOD OF MANUFACTURING BLADE RETAINER AND MANUFACTURING DEVICES THEREFOR

BACKGROUND OF THE INVENTION

The present invention relates to a method of manufacturing a gas turbine blade retainer and corresponding manufacturing devices therefor. More specifically, the present invention relates to a method of manufacturing a gas turbine blade retainer employing shock absorbing materials and corresponding devices therefor.

The present application is based on Japanese Patent Application No. 2002-095683, which application is incorporated herein in its entirety by reference.

Turbine blades of gas turbines in general, and jet engine turbine blades in particular, are inserted into slots formed on the outer perimeter of disks disposed at the center of the gas turbines. The turbine blades are affixed to respective ones of the disks by blade retainers.

Japanese Patent Application No. Heisei 11-270303 describes a prior art method for affixing the turbine blades. As shown in FIG. 1, an L-shaped retainer 53 formed from a rectangular metal sheet with one end bent, is inserted together with a bucket 54 into a slot 52, a plurality of which are formed on the periphery of a disk 51. It will be noted that the bucket 54 is affixed to the disk 51 by bending the other end of the retainer 53. Additional details regarding the retainer 53 will now be provided while referring to FIG. 2.

In FIG. 2, the retainer 53 is formed from a flat rectangular metal bar having a semi-cylindrical cross section. In general, the retainer 53 is formed from a hard metal such as Inconel. The retainer 53 includes a latch section 56 that is bent at one end almost perpendicularly to a adjacent section 55, which is depicted as a long and narrow bar portion. Furthermore, the opposite end of the retainer 53 includes a bendable piece 57 that possesses a stepped section designed to be bent easily when affixing the bucket 54 to the disk 51.

Formation of the retainer 53 will now be described with reference to FIGS. 3, 4*a* and 4*b*, which figures illustrate punching of bar stock material to form a blank and subsequent pressing or bending of the blank into its final form.

As shown in FIG. 3, a flat, long, and narrow bar stock material 62, which is formed in advance by drawing out a bar having a semi-cylindrical cross section, is inserted from the outside of a support 60 into a slot, i.e., a bore, 61 provided at the support 60. It will be appreciated that there are two such supports 59 and 60, which are arranged in a parallel standing condition at a specified interval on a base 58. When the advancing end of the bar stock material 62 comes into contact with the support 59, further movement is prevented. It will also be appreciated that the bar stock material 62 is supported by a receiving die 64 that is freely movable up and down by virtue of the one or more springs 63 (two being depicted) attached between the receiving die 64 and the base 58. It will be noted that the die moves in the downward direction under the impact of a punch 65. One of ordinary skill in the art will recognize that the punch 65 generally possesses a blade width that is equal to the separation between the supports 59 and 60. When the punch 65 drops, the bar stock material 62 is cut into a workpiece, or blank, 75 having the desired dimensions.

As shown in FIG. 4*a*, the blank 75, which includes distal and proximal ends 75*a* and 75*b*, respectively, is then positioned on a bending die 70, with the distal end 75*a* being in contact with a stop 73. It will be noted that the bending die 70 includes a V-shaped groove 72 that is cut out of the surface supporting the blank at a predetermined angle. A convex punch 71 having a shape that matches the profile of the V-shaped groove 72 of the bending die 70 can then be pressed into the blank 75 from above, causing the blank 75 to bend to form the desired angular shape, as shown in FIG. 4*b*, to produce a bent blank 76 having distal and proximal ends 76*a* and 76*b*. Subsequently, the bendable piece 57, i.e., the portion of the retainer 53 having the stepped profile that is easily bent when affixing the bucket 54 to the disk 51 illustrated in FIG. 2, is formed at the proximal end 76*b* of the bent blank 76, thereby forming the retainer 53.

It will be appreciated that in manufacturing the prior art retainer 53, when the blank 75 is cut from the bar stock material 62, a displacement of the bar stock material 62 occurs. This displacement causes the cutting punch 65 to stray due to lateral pressure, which, in turn, can cause the blank 75 to jump up or warp, or cause the blank 75 to be scored or marred at various locations between the supports 59 and 60 of the cutting jig or cutting press. Furthermore, die breaks occur due to vibration. In addition, the blank 75 is cut longer than the specified dimensions so that, after cutting, the dimensional accuracy of the blank 75 is poor. It will be noted from the arrangement illustrated in FIG. 3 that the blank 75 can be pressed into the receiving die 64 with sufficient force that it subsequently has to be dislodged from the upper surface of the receiving die 64. Thus, the cutting press illustrated in FIG. 3 suffers from poor production efficiency. Moreover, when the blank 75 was placed onto the bending die 70, there was the problem that the cross-sectional configuration of the blank 75 could collapse, leaving one or more scars 74 on the surface of the bar stock material 62 after bending.

It should be mentioned at this point that Japanese Patent Application No. Heisei 11-270303 is also incorporated herein by reference.

SUMMARY OF THE INVENTION

Based on the above and foregoing, it can be appreciated that there presently exists a need in the art for a method and corresponding apparatus for fabricating bent elements that overcomes the above-described deficiencies. The present invention was motivated by a desire to overcome the perceived drawbacks and shortcomings of the presently available technology, and thereby fulfill this need in the art.

According to one aspect, the present invention provides a method of operating a manufacturing system having a material cutting device including a cutting punch having a cutting edge, first and second cutting jig supports having first and second faces, respectively, disposed in parallel a predetermined distance from one another, the first cutting jig support including a bore sized to receive a bar stock material having a predetermined shape, the second cutting jig support including a cutting stopper, and a shock absorber having one surface perpendicular to the second face and proximate to the cutting stopper, and a material bending device including a bending punch, an upright bending support having a chamfered portion, and a receiving slide supported by at least one spring and opposing the bending punch, to produce a generally L-shaped workpiece. The method includes steps for suspending the bar stock material between the shock absorber and the bore of the first cutting jig support, moving the cutting punch downward so as the press the distal end of the bar stock material into the shock absorber and the cutting stopper and then cut the bar stock material to thereby produce a blank, clamping the blank between the bending punch and the receiving slide by pressing the bending punch against the receiving slide, and bending the distal end of the blank against the chamfered portion of the bending support in response to continued downward motion of the bending punch to thereby form the L-shaped workpiece.

According to another aspect, the present invention provides a method of manufacturing a blade retainer for holding a gas turbine blade using a material cutting device including a cutting punch having a cutting edge, first and second cutting jig supports having first and second faces, respectively, disposed in parallel a predetermined distance from one another, the first cutting jig support including a bore sized to receive a bar stock material having a predetermined shape, the second cutting jig support including a cutting stopper, and a shock absorber having one surface perpendicular to the second face and proximate to the cutting stopper, and a material bending device including a bending punch, an upright bending support having a chamfered portion, and a receiving slide supported by at least one spring and opposing the bending punch. Preferably, the method includes steps for suspending the bar stock material between the shock absorber and the bore of the first cutting jig support, moving the cutting punch downward so as the press the distal end of the bar stock material into the shock absorber and the cutting stopper and then cut the bar stock material to thereby cut a blank from the bar stock material, clamping the blank between the bending punch and the receiving slide by pressing the bending punch against the receiving slide, bending the distal end of the blank against the chamfered portion of the bending support in response to continued downward motion of the bending punch to thereby form a blade retainer precursor, and milling the blade retainer precursor to thereby form the blade retainer. If desired, the shock absorber includes polyurethane.

According to yet another aspect, the present invention provides a blade retainer material cutting device for cutting a blank from a bar stock material, including a cutting base, first and second cutting jig supports disposed in a parallel with one another and perpendicular to the cutting base, the first and second cutting jig supports being separated from one another by a predetermined distance, a shock absorbing material supported by the cutting base and adjacent to the second cutting jig support, and a cutting punch including a cutting edge disposed between the first and second cutting jig supports with the cutting edge disposed proximate to the first cutting jig support, the jutting punch being separated from the first cutting jig support be a predetermined interval. In an exemplary and non-limiting case, the first cutting jig support includes a bore sized to admit the bar stock material, the second cutting jig support includes a cutting stopper contacting the distal end of the bar stock material to thereby determine the length of the bar stock material disposed between the first and second cutting jig supports, the bar stock material is suspended between the first cutting jig support and the shock absorbing material prior to cutting the blank, and downward motion of the cutting jig clamps the distal end of the bar stock material to both the shock absorbing material and the cutting stopper. If desired, the cutting punch further includes a groove having a cross-section matching the profile of the bar stock material, the groove intersecting the cutting edge of the cutting punch. Alternatively, the cutting edge of the cutting punch includes first and second cutting edges, and the cutting punch further includes first and second grooves each having a cross-section matching the profile of the bar stock material, the first and second grooves forming a cruciform shape and intersecting a respective one of the cutting edges of the cutting punch. In another exemplary case, the cutting edge of the cutting punch includes first and second cutting edges and third and fourth cutting edges, the first and second cutting edges included in a first end of the cutting punch and the third and fourth cutting edges included in a second end of the cutting punch, and the cutting punch further includes first and second grooves, disposed in the first end of the cutting punch, each of the first and second groves having a cross-section matching the profile of the bar stock material, the first and second grooves forming a cruciform shape and intersecting a respective one of the first and second cutting edges of the cutting punch, and third and fourth grooves, disposed in the second end of the cutting punch, each of the third and fourth groves having a cross-section matching the profile of the bar stock material, the third and fourth grooves forming a cruciform shape and intersecting a respective one of the third and fourth cutting edges of the cutting punch.

According to a further aspect, the present invention provides a blade retainer material bending device including a base, a bending jig support, coupled to the base, having first and second surfaces, the first surface having a first groove accommodating the distal end of a blank, the bending jig support having a chamfered portion of predetermined radius intersecting the groove and the second surface, a receiving slide having a second groove conforming to the profile of the blank in an upper surface of the receiving slide, a shaft that maintains the receiving slide in a predetermined position relative to the base while permitting up and down movement of the receiving slide with respect to the base, a spring operatively coupling the receiving slide to the base, the spring opposing the downward motion of the receiving slide, and a bending punch possessing a cross section parallel to the upper surface of the receiving slide. The bending device can be configured such that the force generated by the spring is greater than the force required to bend the blank. Alternatively, the bending device can be configured to include a polyurethane shim disposed between the receiving slide and the base, so that the clamping force is determined by the spring constant of the spring and the rigidity of the polyurethane shim.

According to a still further aspect, the present invention provides a blade retainer manufacturing system, including a material cutting device that cuts a blank from bar stock material, the cutting device having a cutting base, first and second cutting jig supports disposed in a parallel with one another and perpendicular to the cutting base, the first and second cutting jig supports being separated from one another by a predetermined distance, a shock absorbing material supported by the cutting base and adjacent to the second cutting jig support, a cutting punch including a cutting edge disposed between the first and second cutting jig supports with the cutting edge disposed proximate to the first cutting jig support, the jutting punch being separated from the first cutting jig support be a predetermined interval, and a blade retainer material bending device having a bending base, a bending jig support, coupled to the bending base, having first and second surfaces, the first surface having a first groove accommodating the distal end of a blank, the bending jig support having a chamfered portion of predetermined radius intersecting the groove and the second surface, a receiving slide having a second groove conforming to the profile of the blank in an upper surface of the receiving slide, a shaft that maintains the receiving slide in a predetermined position relative to the base while permitting up and down movement of the receiving slide with respect to the base, a spring operatively coupling the receiving slide to the base, the spring opposing the downward motion of the receiving slide, and a bending punch possessing a cross section parallel to the upper surface of the receiving slide. If desired, the first cutting jig support includes a bore sized to admit the bar stock material, the second cutting jig support includes a cutting stopper contacting the distal end of the bar stock material to thereby determine the length of the bar stock material disposed between the first and second cutting jig supports, the bar stock material is suspended between the first cutting jig support and the shock absorbing material prior to cutting the blank, and downward motion of the cutting jig clamps the distal end of the bar stock material to both the shock absorbing material and the cutting stopper. In an exemplary case, the cutting base and the bending base can be a common base.

BRIEF DESCRIPTION OF THE DRAWINGS

These and various other features and aspects of the present invention will be readily understood with reference to the following detailed description taken in conjunction with the accompanying drawings, in which like or similar numbers are used throughout, and in which.

DETAILED DESCRIPTION OF THE PREFERRED EMBODIMENTS

The present invention is an improvement to the manufacturing devices and corresponding methods that overcome the problems associated with the prior art manufacturing methods described above. The object of the present invention is to provide an improved method of manufacturing a bent device, e.g., a blade retainer, and corresponding manufacturing device(s) therefor, such that the dimensional accuracy of the bent device, e.g., the above-mentioned blade retainer, is enhanced. Preferably, the machines and corresponding methods will eliminate scars on the surface of the bent device while increasing the production efficiency of the manufacturing process.

The various embodiments of the various manufacturing devices, e.g., the cutting and bending presses, included in the manufacturing system and corresponding operating methods will now be described with respect to FIGS. 5 through 10. During the discussion of the various preferred embodiments, the ends of various blanks and bars of material will include references to distal and proximal ends. Distal ends contact stops of one form or another, proximal ends do not.

Figure 5:
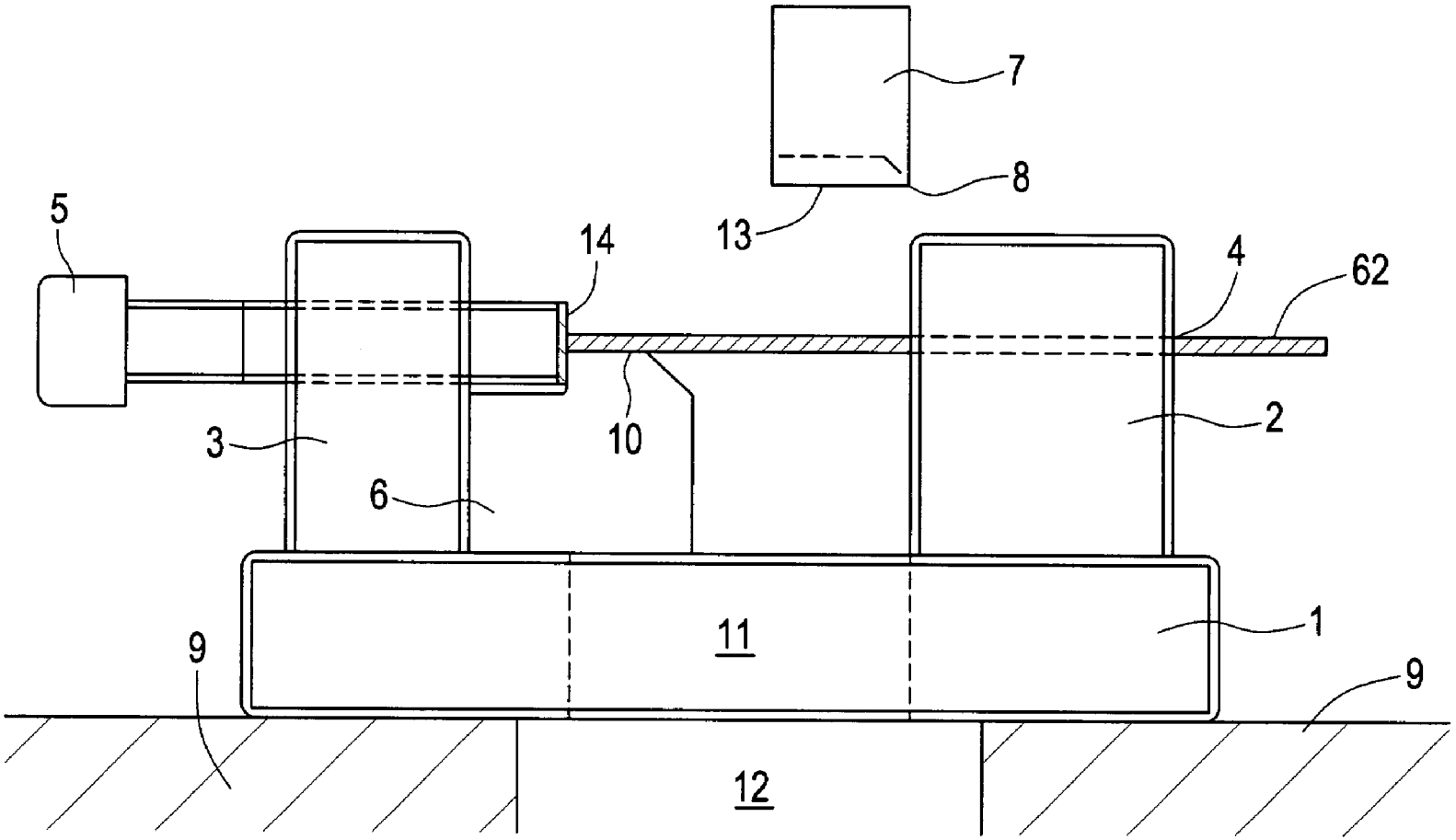
FIG. 5 is a plan view showing the structure of a material cutting device including bar stock material supports and punch that produces a blank according to one preferred embodiment of the present invention.

FIG. 5 is a plan view showing the structure of a material cutting device 100 employed in performing a material cutting operation, i.e., a cutting step in a manufacturing process. As shown in FIG. 5, the material cutting device 100 of the present invention is provided with two cubic cutting jig supports 2 and 3, which are arranged in a parallel to one another and which are supported by a cutting jig base 1 mounted on a press base 9 equipped with a press exhaust port 12. It will be appreciated that the support 2 and 3 are separated from one another by a predetermined distance, e.g., a distance greater than the length of the blank being produced by cutting device 100. The cutting jig base 1 is provided with an exhaust port 11. A slot or bore 4 for supplying bar stock material is drilled completely through the cutting jig support 2.

The cutting jig support 3 advantageously can be provided with a cutting stopper 5 that controls the length of the flat, long, and narrow bar stock material 62 that is to be cut. The cutting stopper 5 preferably possesses a shock damper 14 at the distal end of stopper 5. In addition, a shock absorbing material 6 is provided between the upright cutting jig supports 2 and 3, and extends from the surface of the cutting jig base 1 proximate to the cutting jig support 3 in the vicinity of the cutting stopper 5.

A cubic cutting punch 7 is disposed between the two cutting jig supports 2 and 3, and freely moves up and down parallel to the cutting jig support 2. It will be appreciated that the punch 7 maintains a specified interval from the cutting jig support 2 throughout its travels. The cutting punch 7 advantageously includes a cutting edge 8 disposed in the punch face proximate to the cutting jig support 2. Moreover, a groove 13 that matches the semi-cylindrical cross section of the bar stock material 62 is cut in parallel to the insertion direction of the bar stock material 62 on the lower surface of the cutting punch 7.

In this preferred embodiment according to the present invention, the shock damper 14 utilizes a material that absorbs the displacement of the bar stock material 62, which could cause the cutting punch 7 to stray as a result of lateral pressure arising when cutting the bar stock material 62. In an exemplary case, the shock damper 14 advantageously can be formed from a polyurethane material. It will be appreciated that, since this polyurethane material has a Shore hardness of (A) 90, there is no effect on cutting dimensional accuracy.

Still referring to FIG. 5, it should be mentioned that the shock absorbing material 6 supporting the distal end of the bar stock material 62 possesses a hardness such that the front end of the bar stock material 62 does not sink into, i.e., does not appreciably deform, the shock absorbing material 6 during cutting. It should also be mentioned that this shock absorbing material 6 provides the additional advantage of rapidly absorbing the vibrations arising in the course of cutting the bar stock material 62. In this exemplary embodiment, a polyurethane material {Shore hardness (A) 90} advantageously can be employed as the shock absorbing material 6. It should be mentioned at this point that the other materials employed in the formation of the cutting jig include molybdenum high-speed cutting steel, JIS SKH51 for the cutting punch 7 and the cutting jig support 2, carbon steel for machinery, and JIS S45C for the cutting jig base 1 and the cutting jig support 3.

Figure 6:
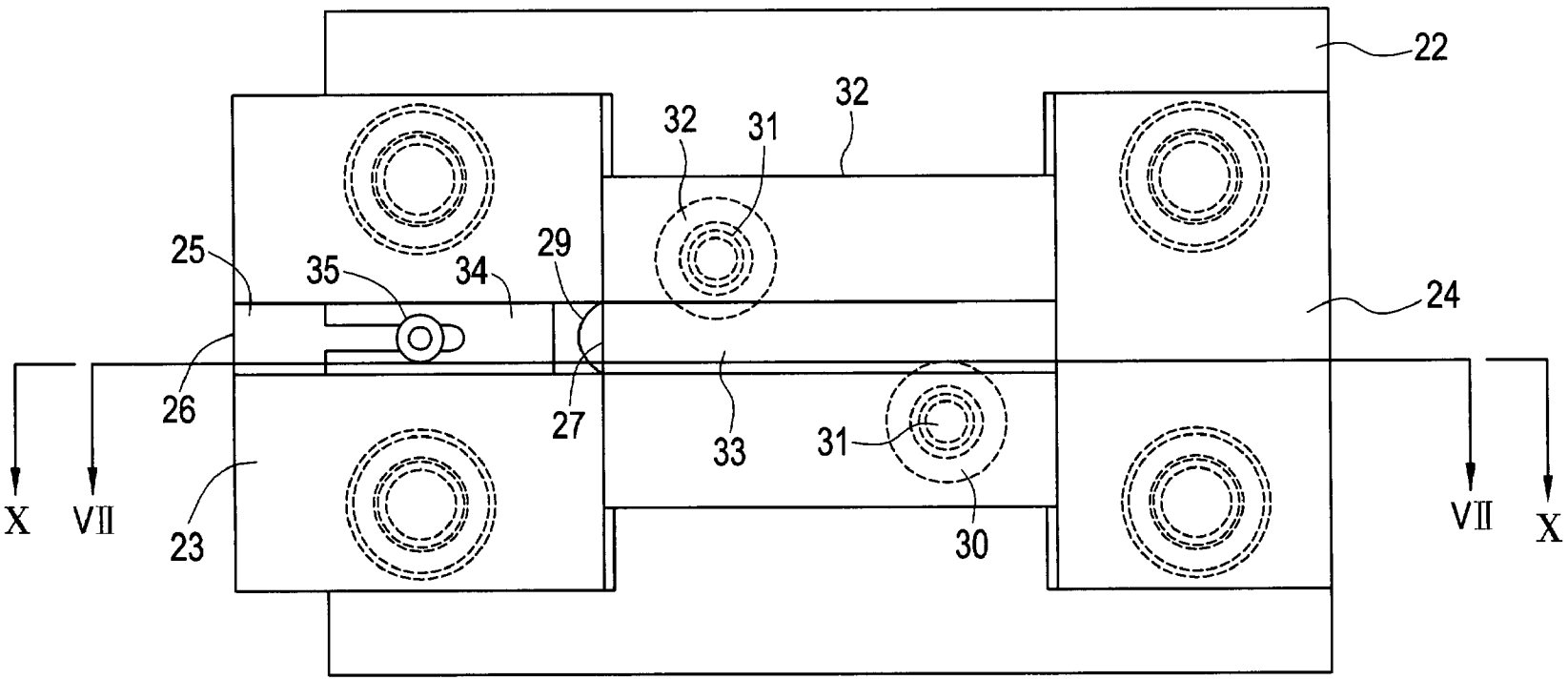
FIG. 6 is a top view of the of the material bending device according to the present invention.
Figure 7:
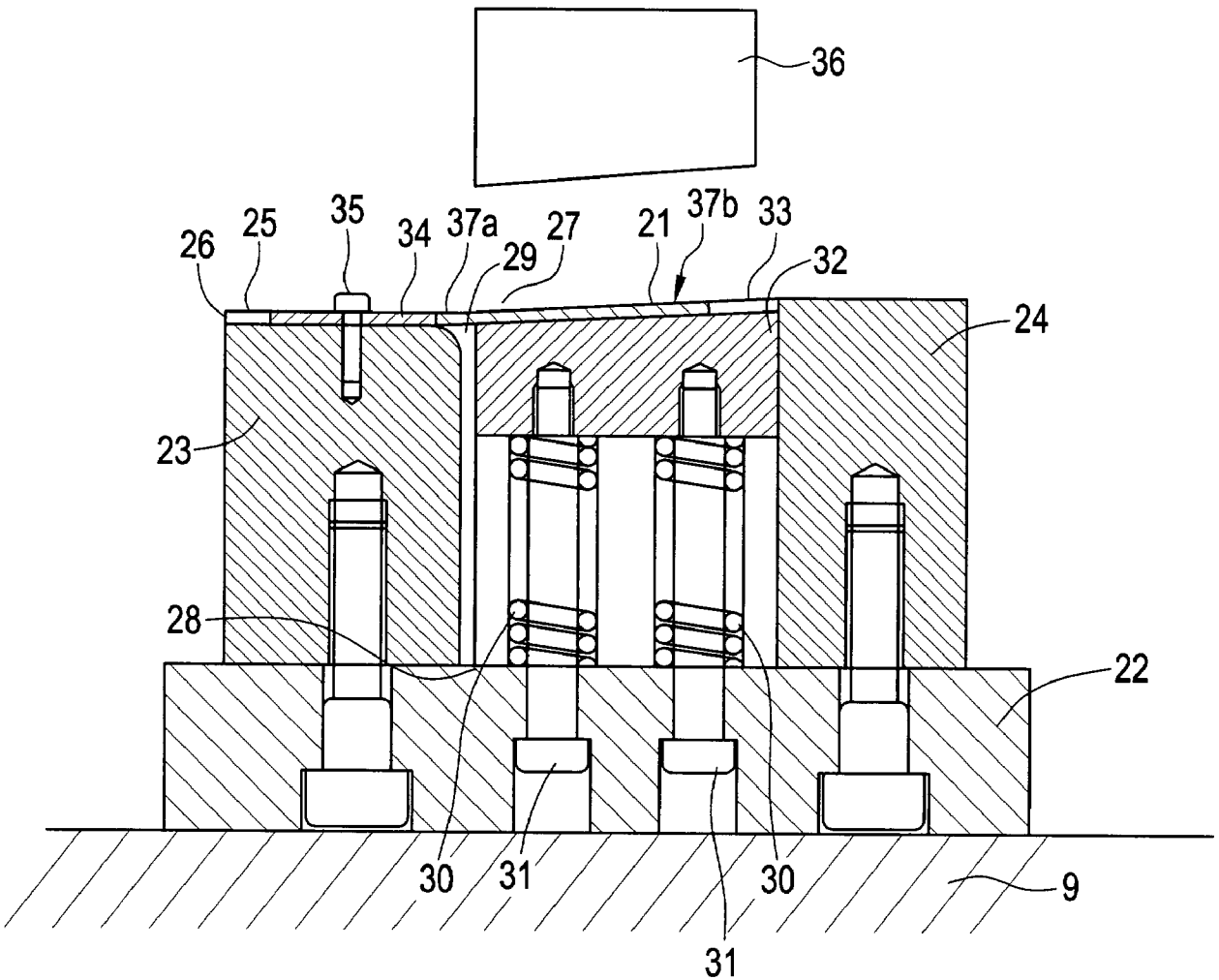
FIG. 7 is a sectional view illustrating in the internal structure of a material bending device 200 depicted in FIG. 6 that bends a blank into a predetermine shape.

FIG. 6 is a top view showing the structure of a material bending device 200 employed in the manufacturing system according to the present invention that performs bending of a material (blank) that has been cut to specified dimensions, preferably using the cutting device 100 discussed above; FIG. 7 is a sectional view taken along the line VII—VII in FIG. 6 showing the internal structure of a material bending device 200. In FIGS. 6 and 7, the material bending device according to the present invention is provided with two cubic bending jig supports 23 and 24, which are arranged in a parallel to one another, which are separated from one another by a predetermined interval, and which are supported by a bending jig base 22 mounted on the press base 9 (discussed above).

The bending jig support 23 advantageously includes a machining groove 25, which preferably is cut into the upper surface and inside surface of the support 23 at a specified depth that matches the width of blank 21. This machining groove 25 extends from a support upper surface outside corner 26 to a support upper surface inside corner 27, and the inside surface is formed so that it drops perpendicularly from the support upper surface inside corner 27 to a support lower surface inside corner 28. A portion of the support 23 is machined to form chamfered portion 29, which provides a specified radius in the corner of the machining groove 25. It should also be noted that a bending stopper 34, which contacts the distal end 37*a* of the blank 21, is inserted into the machining groove 25 of the upper surface of the bending jig support 23, and is secured with a screw 35.

Still referring to FIG. 7, a receiving slide 32 is movably supported by slide spring 30, which permits the slide 32 to freely move up and down relative to the two bending jig supports 23 and 24. It will be appreciated that the slide 32 is fixed in position relative to the bending jig base 22 by at least one shaft 31, which passes completely through the inside of a respective slide spring 30. Preferably, the receiving slide 32 includes a guide groove 33 that possesses a bottom surface parallel to the upper surface of the receiving slide 32. The guide groove 33 has a specified depth that does not exceed the thickness of the blank 21, and a width that matches the width of the blank 21. The bottom surface height of this guide groove 33 on the side of the bending jig support 23 matches the bottom surface height of the machining groove 25.

A bending punch 36 is disposed, at a fully retracted position, a predetermined distance above the bending jig support 23 and between the bending jig supports 23 and 24. Moreover, the bending punch 36 moves freely up and down relative to the bending jig base 22. It will be appreciated from FIG. 7 that the bending punch is disposed in a position to freely press downward on the receiving slide 32. The bending punch 36 has a cross section that is disposed at a specified angle parallel to the top of the receiving slide 32.

Preferably, the chamfered portion 29 of the corner of the machining groove 25 cut into the bending jig support 23 is made such that it will not be damaged when the blank 21 is bent. More preferably, the radius of the chamfered portion 29 is within a range of 2 mm to 10 mm, depending on the hardness of the bar stock material 62 from which the blank 21 is cut and the dimensions of the retainer after bending. In the exemplary embodiment illustrated in FIG. 7, the chamfering radius is in the range of 4 mm to 6 mm.

It should also be mentioned that the inclination of the surface of the bending punch 36 and the upper surface of the receiving slide 32 disposed between the bending jig supports 23 and 24 is determined with consideration given to the returning springback due to elasticity of the blank 21. Moreover, in this method of manufacturing a blade retainer, the inclination angle is adjusted in a range of 0–10 degrees with respect to the horizon such that the bending angle forms an acute angle. In this exemplary embodiment, this angle is 5°±1°. It should be noted that the material forming the parts of the jig of this embodiment is molybdenum high-speed cutting steel, while JIS SKH51 is employed in the bending punch 36, the bending jig support 23, and the receiving slide 32.

The inventive method for manufacturing a retainer holding a gas turbine blade according to a preferred embodiment of the present invention will now be described in detain while referring to the structure illustrated in FIGS. 5–7 in conjunction with the flowchart illustrated in FIG. 8. It will be appreciated from FIG. 8 that the method of employing the devices 100 and 200 illustrated in FIGS. 5 and 6, respectively, is subdivided in to a blank formation or cutting process P1 and a blank bending process P2, as discussed in greater detail immediately below.

Figure 8:
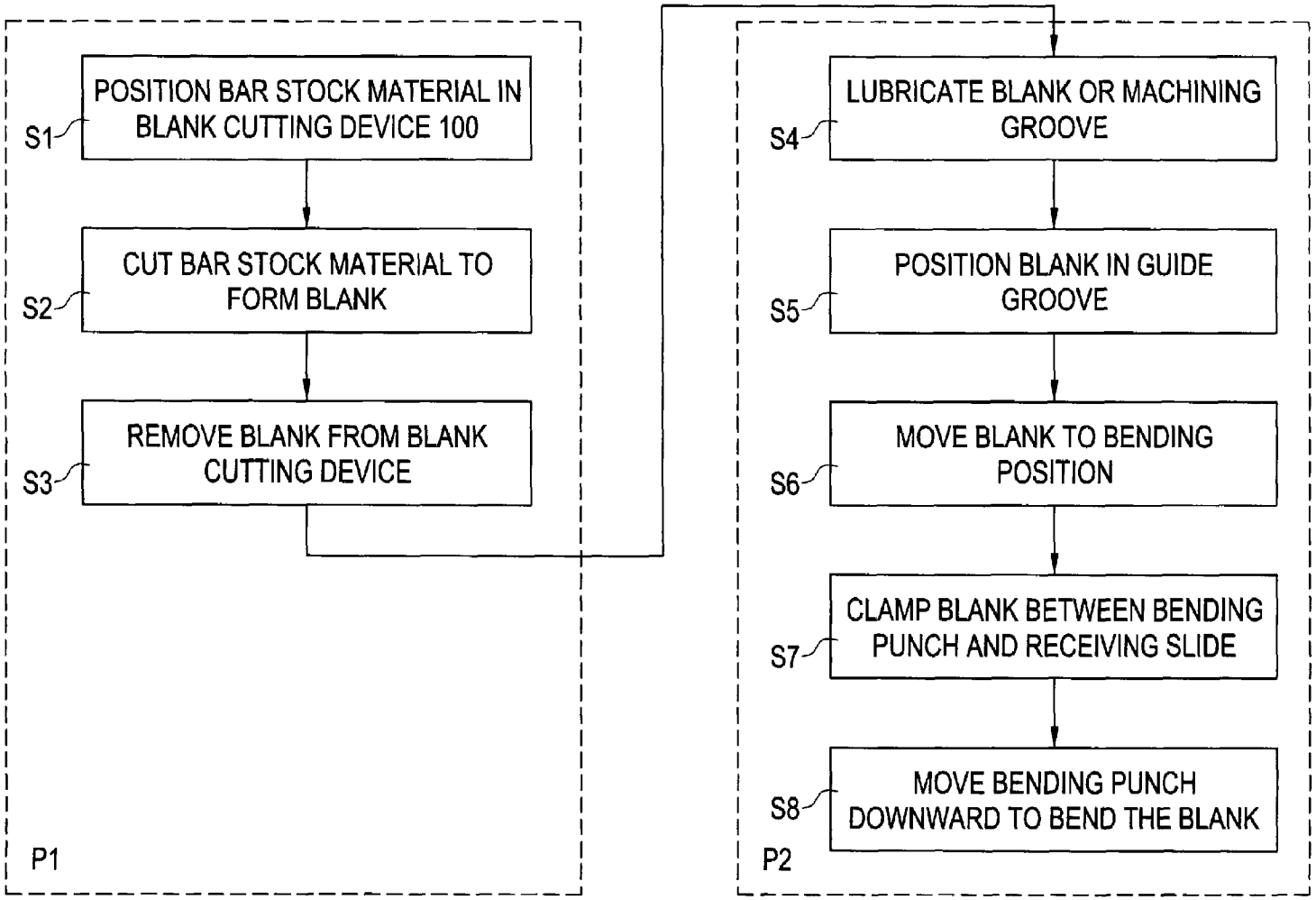
FIG. 8 is a flowchart of an exemplary method for manufacturing a turbine blade retainer according to the present invention.

As shown in FIG. 8, during the blank cutting process P1 in the blade retainer manufacturing method according to the present invention, the bar stock material 62 is inserted in the slot 4 in cutting jig support 2 until the distal end of the material 62 contacts the shock damper 14 of the cutting stopper 5, which prevents further insertion of the bar stock material 62, during step S1. It will be appreciated that this brings the shock absorbing material 6 with a specified hardness into position with respect to the distal end of the flat, long, and narrow bar stock material 62, which ultimately forms the main body of the blade retainer. It will also be appreciated that the shock absorbing material 6 advantageously absorbs the vibrations arising at the distal end when the bar stock material 62 is cut. As shown in FIG. 5, a contact region 10 between the underside of the bar stock material 62 and the upper surface of the shock absorbing material 6 is formed when the distal end of the material 62 contacts the shock damper 14 of the cutting stopper 5, i.e., the distal end of the bar stock material 62 is supported by the shock absorbing material 6.

In a subsequently performed cutting step S2, cutting punch 7 is lowered to cut the bar stock material 62 into a blank 21. It will be appreciated that this forces the distal end of the bar stock material 62 to press against the shock absorbing material 6. In other words, the downward load force of the cutting punch 7 is transferred along the bar stock material 62, forcing the distal end of the material 62 to be pressed against the shock absorbing material 6 in the contact region 10. It will be noted that this automatically clamps the bar stock material into an optimal cutting position. While this clamp state is maintained, the material 62 is sheared to the specified dimensions by the continued motion of the cutting punch 7 relative to the cutting jig support 2. In other word, the downward pressure of the cutting punch 7 first forces the distal end of the bar stock material 62 into a fixed and supported position; continued motion of the cutting punch 7 sheers blank 21 from the material 62. It will be appreciated that the sheared material 62, i.e., the blank 21, falls naturally due to gravity into the exhaust port 11 of the cutting jig base 1 and is disposed of via the press exhaust port 12 in the material cutting device 100 during step S3.

Then, as shown in FIG. 8, the bending process P2 is performed as follows. After the blank 21 has been cut to specified dimensions, lubricating oil is applied to one of the distal end 37*a* of blank 21 and the machining groove 25 (see FIG. 7) during step S4. The blank 21 is then inserted into the guide groove 33 of the receiving slide 32 during step S5. The distal end 37*a* of blank 21 is then advanced during step S6 until it touches the bending stopper 34, so that the blank 21 is laterally mounted across the machining groove 25 and the guide groove 33. The bending punch 36 descends and presses down on the proximal end 37*b* of the blank 21 during step S7. An upward pressure is imparted to the receiving slide 32 due to the spring force arising in the slide spring 30 in response to the downward pressure of the blank 21, resulting in automatically clamping of the proximal end 37*b* of the blank 21 by the bending punch 36 and the receiving slide 32.

During step S8, continued downward motion of the bending punch 36 causes the distal end 37*a* of the blank 21, which is contact with the chamfered portion 29 of the corner of the machining groove 25, to bend. It will be appreciated that while the external force, i.e., downward pressure, exerted by the bending punch 36 is sufficient to bend the blank, it is not sufficient to collapse the blank.

Figure 2:
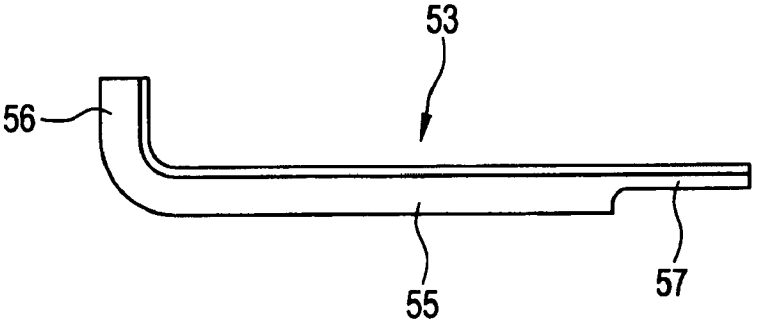
FIG. 2 PRIOR ART
FIG. 2 is a side view of a retainer that holds a gas turbine blade.
Figure 4B:
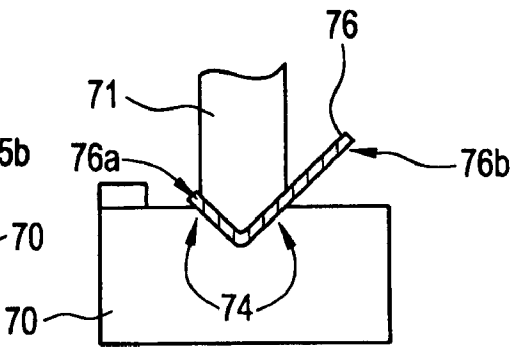
FIG. 4b PRIOR ART
FIGS. 4*a* and 4*b* collectively illustrate a conventional method of bending a blank, formed using the cutting press illustrated in FIG. 3, using a prior art material bending device.
Figure 4A:
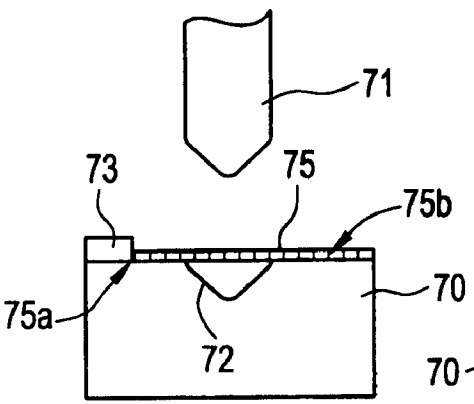
FIG. 4a PRIOR ART
Figure 1:
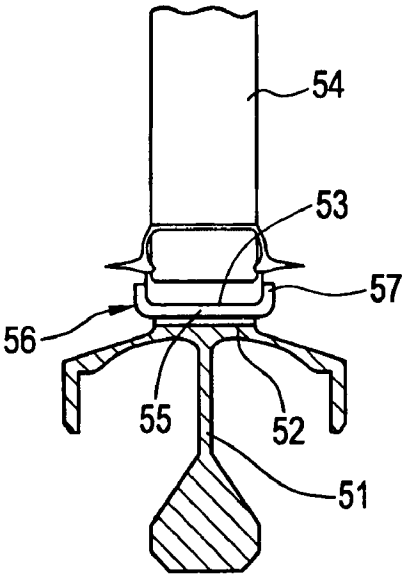
FIG. 1 PRIOR ART
FIG. 1 is a sectional view of a retainer that holds a gas turbine blade.
Figure 3:
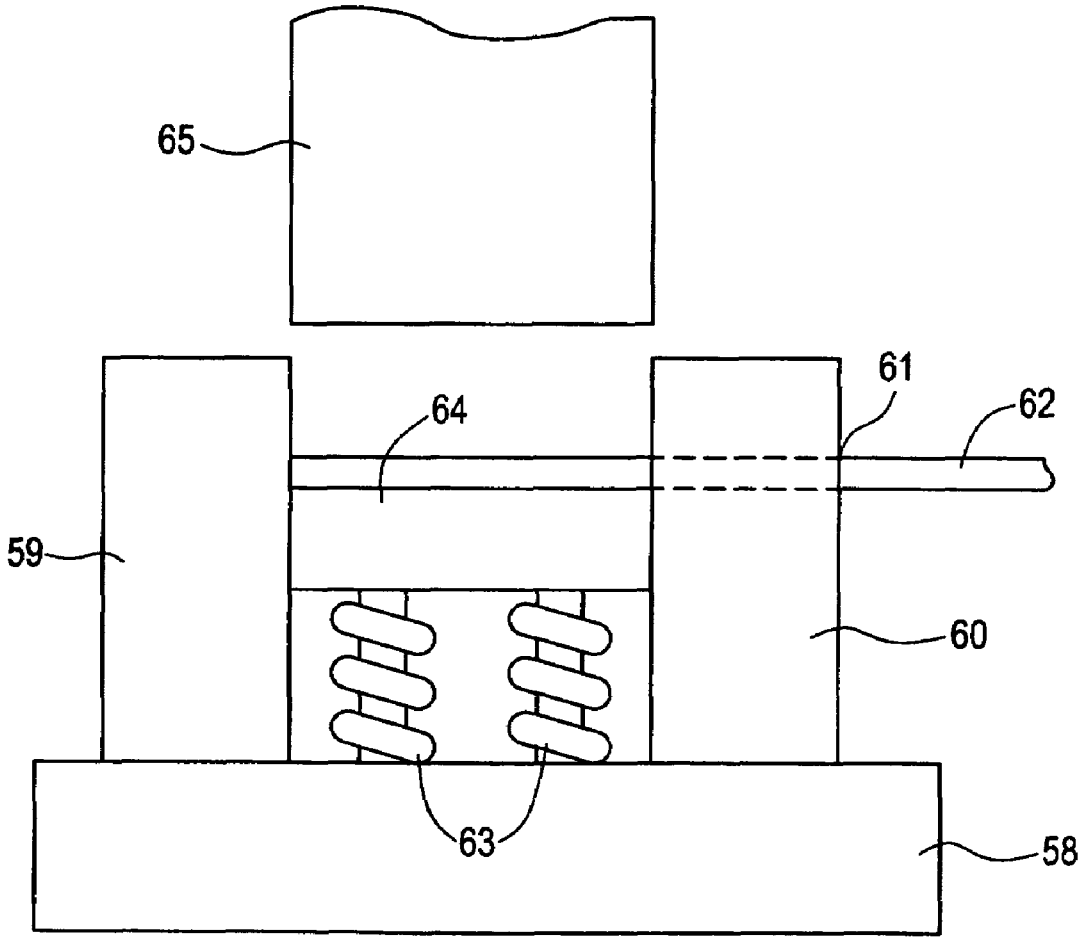
FIG. 3 PRIOR ART
FIG. 3 is a schematic drawing showing the structure of a prior art material cutting press employed in manufacturing the blank depicted in FIG. 2.

Due to the fact that lubricating oil is applied to either the distal end 37*a* of blank 21 or the machining groove 25, and due to the fact that an arc-shaped chamfered portion 29 (chamfering radius of 4 mm to 6 mm) is provided at the corner of the machining groove 25, there is less frictional force between the blank 21 and the bending jig support 23 when bending occurs. As a result, bending can be achieved without damaging the surface of the blank 21. Moreover, due to the fact that the blank 21 is inserted into the guide groove 33, and automatically clamped between the bending punch 36 and the receiving slide 32, a surface load is applied to the blank 21. Contrast this with the point load on the blank 75 applied by the bending press illustrated in FIGS. 4*a* and 4*b*. As a result, it is possible to prevent cross-sectional deformation at the bending site since the load is distributed.

It will be appreciated that the machining process, e.g., milling, by which a step is formed on the proximal end of the blank 21 subsequent to step S8 is well known to one of ordinary skill in the art. Thus, additional discussion of this machining process will not be provided.

Thus, a first preferred embodiment regarding a manufacturing system and a second preferred embodiment regarding a manufacturing method have now be described in detail. It will be appreciated that while the discussion of the various embodiments was directed to, for example, an inventive method of manufacturing a retainer for holding a blade of a gas turbine, the present invention is not so limited. The present invention is applicable to the fabrication of numerous bent metal parts. The discussion that follows presents additional embodiments and variations of certain elements of the devices 100 and 200.

In the discussion above, the shock damper 14 was described as being made from polyurethane. Other materials advantageously can be employed. For example, a low-hardness metal (aluminum, brass, copper, zinc, or the like), rubber, or a synthetic polymer other than polyurethane, or a spring, can be employed as the shock damper 14 provided at the end of the cutting stopper 5 of the material cutting device 100 depicted in FIG. 5. As in the case of the shock damper 14, a material or part can be employed that absorbs the displacement of the bar stock material 62, which displacement causes the straying of the cutting punch 7. It will be appreciated that the selected material or part acting as the shock damper is selected for hardness, and configured and dimensioned to compliment the characteristics of the bar stock material 62.

Furthermore, the material in the contact region 10 of the inserted bar stock material 62 advantageously can be supported by a shock absorbing material such as rubber, or a synthetic resin other than polyurethane, or a spring, arranged parallel to the cutting support 3 as the shock absorbing material 6 to thereby rapidly absorb vibrations. It will be appreciated that the hardness of the material, as well as the configuration and dimensions, are dictated by the physical characteristics of the bar stock material 62.

Figure 9B:
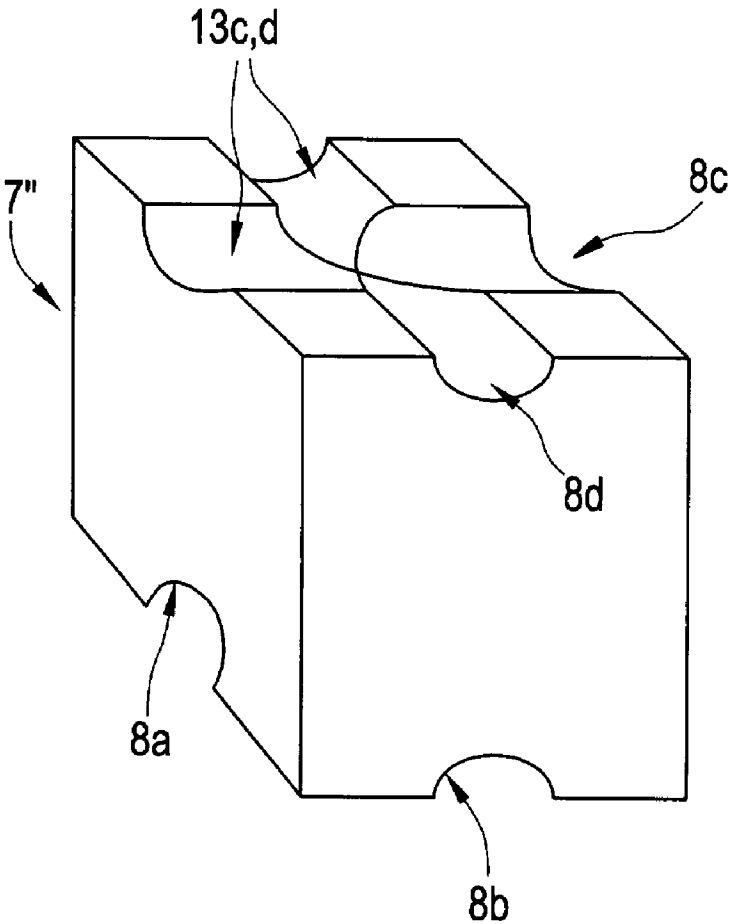
FIGS. 9*a* and 9*b* are diagrammatic views of alternative embodiments of the cutting punch illustrated in FIG. 5.
Figure 9A:
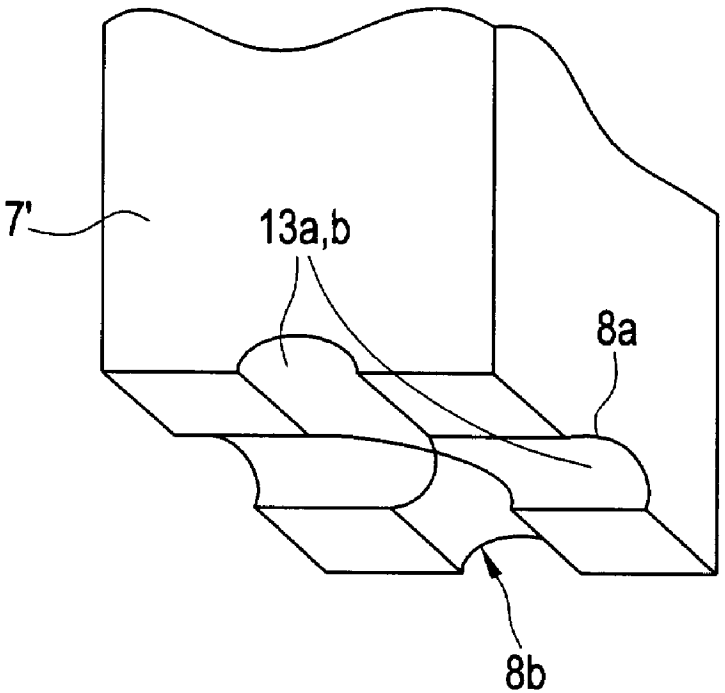

The cubic cutting punch 7 of the material cutting device of FIG. 5 possesses a cutting edge 8 and a groove 13, the latter matching the semi-cylindrical cross section of the bar stock material 62 in cubic profile. Cutting punch 7 is disposed at a predetermined distance from the cutting jig support 2 through which the slot 4 passes. FIG. 9*a* illustrates an alternative cutting punch 7', in which a pair of grooves 13*a* and 13*b* intersect to form a cruciform shape. It will be appreciated that each of grooves 13*a*, 13*b*, ends with a corresponding cutting edge 8*a*, 8*b*, on two faces of the cubic cutting punch 7' body. It will be appreciated that, is this way, the useful life of the cutting punch can be extended by increasing the number of the cut edges. Moreover, as illustrated in FIG. 9*b*, the useful life of the cutting punch can be further extended by cutting two grooves that match the semi-cylindrical cross section of the bar stock material 62, each having a respective cutting edge, in the upper and lower surfaces of the cutting punch. Thus, the cutting punch 7" illustrated in FIG. 9*b* includes grooves 13*a*–13*d* and cutting edges 8*a*–8*d*.

It should also be mentioned that the grooves generally denoted 13 and the cutting ends denoted 8 advantageously need not be identical. It may be desirable to equip, for example, cutting punch 7" with grooves accommodating several different bar stock profiles so that several different sizes of blade retainers can be manufactured with minimal set up time between retainer blade production runs.

Figure 10:
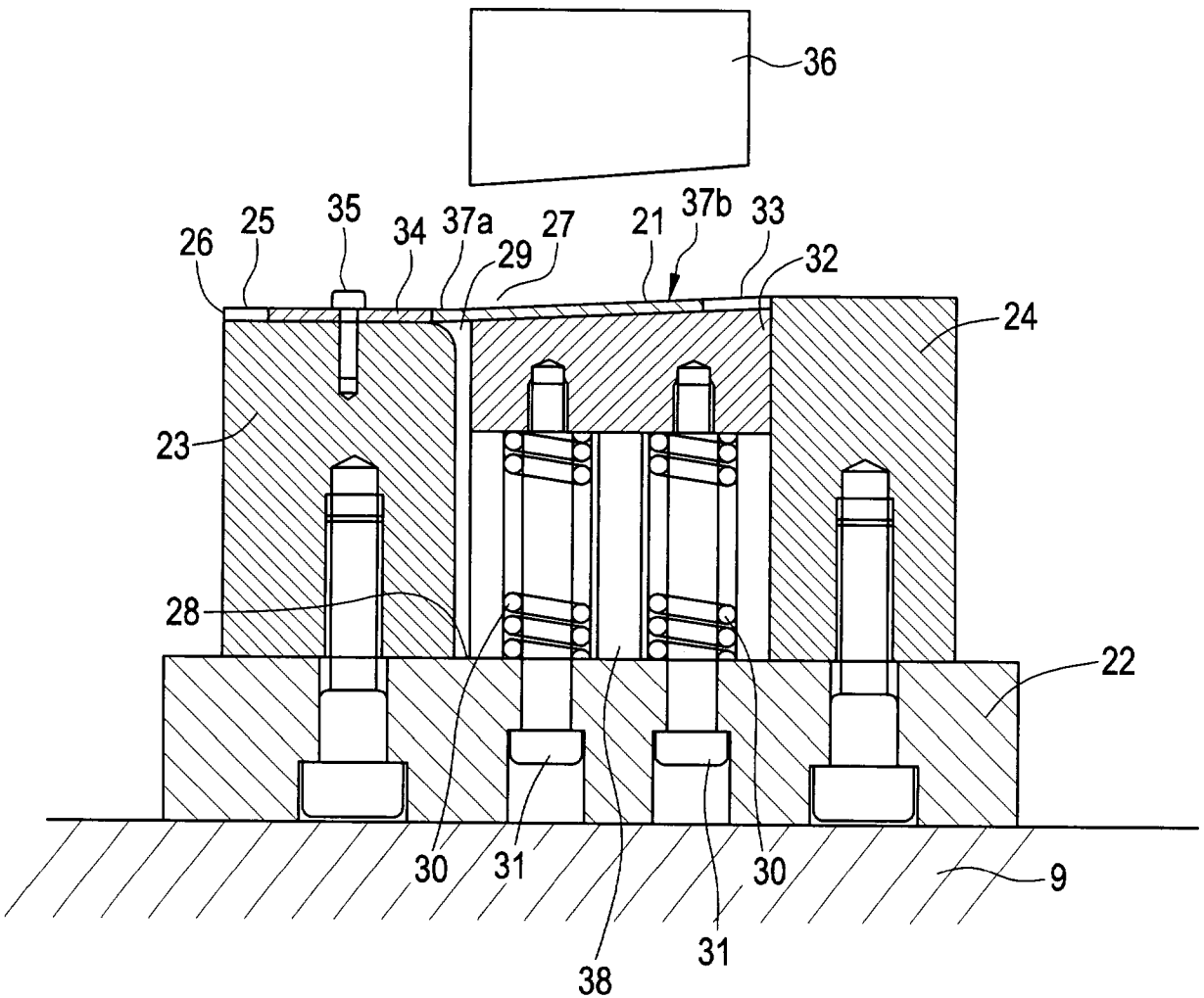
FIG. 10 is a sectional view of another alternative embodiment of the material bending device 200 for bending a blank illustrated in FIG. 7.

FIG. 10 is a sectional view of an alternative exemplary embodiment according to the present invention, which view shows the structure of a material bending device 200' for bending the blank 21. When identical reference numbers are employed in FIGS. 7 and 10, the same functional parts of the device 200 are depicted. Thus, a detailed discussion of like numbered items will not be repeated. The discussion of the alternative embodiment of the material bending device 200' illustrated in FIG. 10 will focus on the polyurethane 38 disposed between two slide springs 30, which elements collectively support the receiving slide 32 while allowing it to move freely up and down.

The material bending device 200 of FIG. 7 employs a commercially available coil spring as the slide spring 30 that supports the receiving slide 32. However, there are situations in which the vertical rigidity of the spring is insufficient, particularly when a commercial coil spring is employed. In this case, when the blank 21 presses down on the chamfered portion 29, the rigidity of the blank 21 permits the force applied via the bending punch 36 to pry the receiving slide 32 away from the bending punch 36. In other words, the blank 21 functions as a lever. Thus, the blank 21 can no longer be clamped in the appropriate position for bending and the blank 21 cannot be bent. It will be appreciated that the stiffness of the springs of the material bending device 200 can be increased by changing the spring constant of the coil spring. However, when there is(are) no suitable commercially available coil spring(s), a( ) custom spring(s) would have to be manufactured, which would substantially increase the cost of the device 200.

A suitable but lower cost material bending device 200' includes a polyurethane member 38 disposed between the two slide springs 30, as illustrated in FIG. 10. It will be appreciated that the member, i.e., shim, 38 compensates for the lack of rigidity of the slide springs 30 without increasing the cost or the time to manufacture the bending device 200' appreciably. It will be appreciated that the combination of the member 38 with the slide springs 30 make it possible to perform stable bending of the blank 21.

Thus, the present invention provides a method of manufacturing turbine blade retainers for gas turbines with improved dimensional accuracy of the final retainer, at a greater production efficiency, and without the formation of pressure defects on the surface of the retainer. Advantageously, the inventive method includes steps for:

providing a shock absorbing material having a predetermined hardness;

sliding the distal end of a bar stock material through a bore disposed in a support into contact with the shock absorbing material;

moving a cutting punch relative to the support to thereby cut a blank from the bar stock material;

automatically clamping the proximal end of the blank; and creating a bend at the distal end of the blank by moving the automatically clamped blank relative to a chamfered portion of a bending support, wherein:

the shock absorbing material absorbs the vibration generated at the distal end of the bar stock material when the proximal end of the bar stock material is cut. Beneficially, the cutting operation causes the bar stock to move along the shock absorbing material until the distal end of the bar stock material firmly engages with a cutting stopper equipped with a shock damper. It will be appreciated that this movement firmly seats the bar stock material against the cutting stopper.

In an exemplary case, the shock absorbing material is polyurethane. Thus, the resiliency of the polyurethane of a specified height is used in clamping the bar stock material during the cutting operation. If desired, the shock damper of the cutting stopper is also polyurethane.

The turbine blade manufacturing system according to the present invention advantageously includes a blade retainer material cutting device and a blade retainer material bending device. Preferably, the material cutting device includes first and second cutting jig supports disposed a predetermined distance from and in parallel with one another and projecting vertically from a cutting jig base, and a cutting punch disposed proximate to the first cutting jig support and movable relative thereto. In an exemplary case, the first cutting jig support includes a bore disposed therein while the second cutting jig support includes a cutting stopper having a shock damper facing the first cutting jig support. Moreover, a shock absorbing material is supported be the cutting jig base and disposed between the first and second cutting jig supports proximate to the cutting stopper such that bar stock material passing through the bore in the first cutting jig support contacts both the shock absorbing material and the shock damper.

Furthermore, the material bending device advantageously includes two bending jig supports arranged in a parallel standing condition at a specified interval on a bending jig base, a receiving slide that is maintained in a fixed location over the bending jig base, and freely movable up and down relative to the bend jig base by virtue of a slide spring, and a bending punch possessing a cross section parallel to the upper surface of the receiving slide. In an exemplary case, the one of the bending jig supports includes a machining groove having a profile that matches the width of the blank cut to specified dimensions and cut into the upper surface of one of the bending jig supports, a chamfered portion with a specified radius implemented at the corner of the machining groove, and a bending stopper inserted into the machining groove. The receiving slide possesses a specified angle gradient on the upper surface and a bottom surface guide groove, which guide groove is parallel to the upper surface of the receiving slide. The depth of the guide grooved does not exceed the thickness of the blank; the width of the guide groove matches the width of the blank.

Although presently preferred embodiments of the present invention have been described in detail herein, it should be clearly understood that many variations and/or modifications of the basic inventive concepts herein taught, which may appear to those skilled in the pertinent art, will still fall within the spirit and scope of the present invention, as defined in the appended claims.

What is claimed is:

1. A method of operating a manufacturing system having a material cutting device including a cutting punch having a cutting edge, first and second cutting jig supports having first and second faces, respectively, disposed in parallel a predetermined distance from one another, the first cutting jig support including a passage sized to receive a bar stock material having a predetermined shape, the second cutting jig support including a cutting stopper, and a shock absorbing material, wherein the shock absorbing material is a material that rapidly absorbs vibrations, the shock absorbing material having one surface perpendicular to the second face and proximate to the cutting stopper, and wherein the manufacturing system further includes a material bending device, which is separate from the material cutting device, including a bending punch, an upright bending support having a chamfered portion, and a receiving slide supported by at least one spring and opposing the bending punch, to produce a generally L-shaped workpiece, the method comprising:

supporting the bar stock material between the shock absorbing material and the first cutting jig support, wherein a distal end of the bar stock material contacts the cutting stopper, and a section of the bar stock material between the first cutting jig support and the shock absorbing material is unsupported;

moving the cutting punch downward so as to press the distal end of the bar stock material into the shock absorbing material and the cutting stopper and then cut the bar stock material to thereby produce a blank;

subsequently, in the material bending device, clamping the blank between the bending punch and the receiving slide by pressing the bending punch against the receiving slide; and bending the distal end of the blank against the chamfered portion of the bending support in response to continued downward motion of the bending punch to thereby form the L-shaped workpiece.

2. A method of manufacturing a blade retainer for holding a gas turbine blade using a material cutting device including a cutting punch having a cutting edge, first and second cutting jig supports having first and second faces, respectively, disposed in parallel a predetermined distance from one another, the first cutting jig support including a passage sized to receive a bar stock material having a predetermined shape, the second cutting jig support including a cutting stopper, and a shock absorbing material, wherein the shock absorbing material is a material that rapidly absorbs vibrations, the shock absorbing material having one surface perpendicular to the second face and proximate to the cutting stopper, and wherein the manufacturing system further includes a material bending device, which is separate from the material cutting device, including a bending punch, an upright bending support having a chamfered portion, and a receiving slide supported by at least one spring and opposing the bending punch, the method comprising:

supporting the bar stock material between the shock absorbing material and the first cutting jig support, wherein a distal end of the bar stock material contacts the cutting stopper, and a section of the bar stock material between the first cutting jig support and the shock absorbing material is unsupported;

moving the cutting punch downward so as to press the distal end of the bar stock material into the shock absorbing material and the cutting stopper and then cut the bar stock material to thereby cut a blank from the bar stock material;

subsequently, in the material bending device, clamping the blank between the bending punch and the receiving slide by pressing the bending punch against the receiving slide;

bending the distal end of the blank against the chamfered portion of the bending support in response to continued downward motion of the bending punch to thereby form a blade retainer precursor; and milling the blade retainer precursor to thereby form the blade retainer.

3. The method as recited in claim 2, wherein the shock absorbing material comprises polyurethane.

4. The method as recited in claim 2, wherein:

the cutting stopper includes a shock damper comprising polyurethane; and the supporting step comprises supporting the bar stock material such that the bar stock material is in contact with the shock damper.

5. The method as recited in claim 2, wherein the force clamping the bending punch and the receiving slide is greater than the force required to bend the blank.

6. The method as recited in claim 5, wherein the clamping force is determined by the spring constant of the at least one spring supporting the receiving slide.

7. The method as recited in claim 5, wherein the clamping force is determined by the constant spring of the at least one spring and the resiliency of a polyurethane shim resisting downward motion of the receiving slide.

8. A blade retainer material cutting device for cutting a blank from a bar stock material, comprising:

a cutting base;

first and second cutting jig supports disposed in parallel with one another and perpendicular to the cutting base, the first and second cutting jig supports being separated from one another by a predetermined distance;

a shock absorbing material supported by the cutting base and adjacent to the second cutting jig support, wherein the shock absorbing material includes one of polyurethane, synthetic resin other than polyurethane, and rubber; and a cutting punch including a cutting edge disposed between the first and second cutting jig supports with the cutting edge disposed proximate to the first cutting jig support, the cutting punch being separated from the first cutting jig support be a predetermined interval, wherein:

the first cutting jig support includes a passage sized to admit the bar stock material;

the second cutting jig support includes a cutting stopper contacting the distal end of the bar stock material to thereby determine the length of the bar stock material disposed between the first and second cutting jig supports;

the bar stock material is unsupported between the first cutting jig support and the shock absorbing material prior to cutting the blank; and motion of the cutting punch with respect to the bar stock material presses the distal end of the bar stock material against the shock absorbing material and clamps the bar stock material between the cutting punch and the shock absorbing material.

9. The device blade retainer material cutting device as recited in claim 8, wherein the cutting stopper further comprises a shock damper.

10. The device blade retainer material cutting device as recited in claim 9, wherein the shock damper comprises polyurethane.

11. The blade retainer material cutting device as recited in claim 8, wherein the cutting punch further comprises a groove having a cross-section matching the profile of the bar stock material, the groove intersecting the cutting edge of the cutting punch.

12. The blade retainer material cutting device as recited in claim 8, wherein:

the cutting edge of the cutting punch comprises first and second cutting edges; and the cutting punch further comprises first and second grooves each having a cross-section matching the profile of the bar stock material, the first and second grooves forming a cruciform shape and intersecting a respective one of the cutting edges of the cutting punch.

13. The blade retainer material cutting device as recited in claim 8, wherein:

the cutting edge of the cutting punch comprises first and second cutting edges and third and fourth cutting edges, the first and second cutting edges included in a first end of the cutting punch and the third and fourth cutting edges included in a second end of the cutting punch; and the cutting punch further comprises:

first and second grooves, disposed in the first end of the cutting punch, each of the first and second groves having a cross-section matching the profile of the bar stock material, the first and second grooves forming a cruciform shape and intersecting a respective one of the first and second cutting edges of the cutting punch; and third and fourth grooves, disposed in the second end of the cutting punch, each of the third and fourth groves having a cross-section matching the profile of the bar stock material, the third and fourth grooves forming a cruciform shape and intersecting a respective one of the third and fourth cutting edges of the cutting punch.

14. A blade retainer material bending device, comprising:

a base;

a bending jig support, coupled to the base, having first and second surfaces, the first surface having a first groove accommodating the distal end of a blank, the bending jig support having a chamfered portion of predetermined radius intersecting the groove and the second surface;

a receiving slide having a second groove conforming to the profile of the blank in an upper surface of the receiving slide;

a shaft that maintains the receiving slide in a predetermined position relative to the base while permitting up and down movement of the receiving slide with respect to the base;

a spring operatively coupling the receiving slide to the base, the spring opposing the downward motion of the receiving slide;

a polyurethane shim disposed between the receiving slide and the base; and a bending punch possessing a lower surface that is parallel to the upper surface of the receiving slide, wherein a clamping force applied to the blank by the receiving slide is determined by the spring constant of the spring and the rigidity of the polyurethane shim.

15. The blade retainer material bending device as recited in claim 14, wherein the force generated by the spring is greater than the force required to bend the blank.

16. A blade retainer manufacturing system, comprising:

a material cutting device that cuts a blank from bar stock material, the cutting device including:

a cutting base;

first and second cutting jig supports disposed in parallel with one another and perpendicular to the cutting base, the first and second cutting jig supports being separated from one another by a predetermined distance;

a shock absorbing material supported by the cutting base and adjacent to the second cutting jig support;

a cutting punch including a cutting edge disposed between the first and second cutting jig supports with the cutting edge disposed proximate to the first cutting jig support, the cutting punch being separated from the first cutting jig support by a predetermined interval; and a blade retainer material bending device, including:

a bending base;

a bending jig support, coupled to the bending base, having first and second surfaces, the first surface having a first groove accommodating the distal end of a blank, the bending jig support having a chamfered portion of predetermined radius intersecting the groove and the second surface;

a receiving slide having a second groove conforming to the profile of the blank in an upper surface of the receiving slide;

a shaft that maintains the receiving slide in a predetermined position relative to the base while permitting up and down movement of the receiving slide with respect to the base;

a spring operatively coupling the receiving slide to the base, the spring opposing the downward motion of the receiving slide; and a bending punch possessing a lower surface that is parallel to the upper surface of the receiving slide, wherein:

the bending punch is separate from the cutting punch and operates at a different time than the cutting punch;

the first cutting jig support includes a passage sized to admit the bar stock material;

the second cutting jig support includes a cutting stopper contacting the distal end of the bar stock material to thereby determine the length of the bar stock material disposed between the first and second cutting jig supports;

the bar stock material is unsupported between the first cutting jig support and the shock absorbing material prior to cutting the blank; and motion of the cutting punch with respect to the bar stock material presses the distal end of the bar stock material against the shock absorbing material and clamps the bar stock material between the cutting punch and the shock absorbing material.

17. The blade retainer manufacturing system as recited in claim 16, wherein the shock absorbing material comprises polyurethane.

18. The blade retainer manufacturing system as recited in claim 16, wherein the cutting punch further comprises a groove having a cross-section matching the profile of the bar stock material, the groove intersecting the cutting edge of the cutting punch.

19. The blade retainer manufacturing system as recited in claim 16, wherein:

the cutting edge of the cutting punch comprises first and second cutting edges; and the cutting punch further comprises first and second grooves each having a cross-section matching the profile of the bar stock material, the first and second grooves forming a cruciform shape and intersecting a respective one of the cutting edges of the cutting punch.

20. The blade retainer manufacturing system as recited in claim 16, wherein:

the cutting edge of the cutting punch comprises first and second cutting edges and third and fourth cutting edges, the first and second cutting edges included in a first end of the cutting punch and the third and fourth cutting edges included in a second end of the cutting punch; and the cutting punch further comprises:

first and second grooves, disposed in the first end of the cutting punch, each of the first and second groves having a cross-section matching the profile of the bar stock material, the first and second grooves forming a cruciform shape and intersecting a respective one of the first and second cutting edges of the cutting punch; and third and fourth grooves, disposed in the second end of the cutting punch, each of the third and fourth groves having a cross-section matching the profile of the bar stock material, the third and fourth grooves forming a cruciform shape and intersecting a respective one of the third and fourth cutting edges of the cutting punch.

21. The blade retainer manufacturing system as recited in claim 16, wherein the force generated by the spring is greater than the force required to bend the blank.

22. The blade retainer manufacturing system as recited in claim 16, wherein:

the blade retainer material bending device further comprises a polyurethane shim disposed between the receiving slide and the base; and the clamping force is determined by the spring constant of the spring and the rigidity of the polyurethane shim.

* * * * *